US007100988B1

(12) United States Patent
Hyslop

(10) Patent No.: US 7,100,988 B1
(45) Date of Patent: Sep. 5, 2006

(54) CHILD'S HIGHCHAIR WITH A RECLINING BACK

(76) Inventor: William J. Hyslop, 105 Jefferson Valley, Coatesville, IN (US) 46121

( * ) Notice: Subject to any disclaimer, the term of this patent is extended or adjusted under 35 U.S.C. 154(b) by 0 days.

(21) Appl. No.: 10/860,622

(22) Filed: Jun. 3, 2004

(51) Int. Cl.
*A47D 1/02* (2006.01)

(52) U.S. Cl. ..... 297/376

(58) Field of Classification Search ..... 297/376, 297/374, 256.1, 354.13, 354.12, 357, 353
See application file for complete search history.

(56) References Cited

U.S. PATENT DOCUMENTS 1,984,549 A * 12/1934 Rowland ..... 297/358
2,695,654 A * 11/1954 Boyd ..... 297/423.26
3,076,628 A * 2/1963 Smith et al. ..... 248/586
3,235,308 A * 2/1966 Conner ..... 297/337
3,784,252 A * 1/1974 Peterson ..... 297/364
5,246,272 A * 9/1993 Kato et al. ..... 297/364
5,681,084 A * 10/1997 Yoneda ..... 297/284.9
6,161,898 A 12/2000 Brevi ..... 297/328
6,334,652 B1 1/2002 Chen et al. ..... 297/357
6,398,304 B1 6/2002 Chen et al. ..... 297/327
6,666,505 B1 * 12/2003 Greger et al. ..... 297/148

* cited by examiner

*Primary Examiner*—Milton Nelson, Jr.
(74) *Attorney, Agent, or Firm*—Woodard, Emhardt, Moriarty, McNett & Henry LLP

(57) ABSTRACT

A child's highchair for receiving a child in a seated orientation includes a supporting frame, a seat supported by the frame, and a back connected to the frame wherein the back is movable between a substantially vertical orientation and a rearwardly tilted or reclining orientation. A release mechanism is integrated into the highchair and includes a release handle, a pair of cable arrangements and securing pins that are movable between a locked position and a released position by manipulation of the release mechanism. With the securing pins in a locked position, the back is fixed in position in a substantially vertical orientation. With the securing pins retracted, the back is able to be moved manually to a reclining position so as to enlarge the included angle between the back and the seat, making it easier to place a child in the highchair.

9 Claims, 6 Drawing Sheets

CHILD'S HIGHCHAIR WITH A RECLINING BACK

BACKGROUND OF THE INVENTION

The present invention relates in general to highchairs for children, typically toddlers, that include a seat portion and a back portion, typically at or near a right angle relative to the seat portion. While minor variations might be seen, the seat is generally horizontal relative to the floor or surface that the highchair is placed upon. The back portion is generally vertical relative to the seat, but there can be a very slight rearward incline or contouring. In order to secure and protect the child, a guard rail extends around the sides and the front of the seat portion at an elevated position above the seat portion. A support post of some type or partitioning strap extends between the seat portion and the guard rail and is normally used at the front of the seat portion. This particular construction results in the creation of two leg holes, one on each side of the center support post or strap. As the child is placed in the highchair, it is necessary to slide one leg into one leg hole and the other leg into the other leg hole, typically at the same time, while lowering the child, facing forward, onto the seat portion.

More specifically, the present invention relates to a release mechanism incorporated into the back portion and the sides of the highchair in order to permit or enable the back portion to recline more rearwardly. The release mechanism is manipulated manually and, once operated, the back portion is able to be manually pivoted rearwardly. While various release mechanisms might be possible to enable the back portion to recline, the preferred embodiment of the present invention allows the release mechanism to be operated with one hand. The other hand can be used to hold the child. This rearward pivot results in reclining the back portion such that its included angle between the back portion and the seat portion can be increased. With the back portion oriented in a substantially vertical position for use, the included angle between the back portion and the seat portion is approximately 90 degrees and could be slightly higher if a slight incline is introduced into the back portion. By operating the release mechanism so that the back portion can be pivoted to a reclining position, the included angle between the back portion and the seat portion is increased to at least between 140 degrees and 150 degrees. Additionally, the construction results in also moving the pivot point rearwardly so as to increase the spacing between the back portion and the guard rail. With the back portion reclined in this manner, it is easier to guide the child and the child's legs into the seat and into the leg holes, respectively. Once the child is properly positioned, the back portion is manually returned to its more upright orientation and locked in position to then be able to support the child. If the back portion is left in the reclining position the child can use the highchair for a nap.

While the present invention is illustrated and described with respect to one style of highchair, it should be understood that the release mechanism and the reclining back portion can be added or integrated into virtually any highchair. Whatever minor design modifications might be required due to the specific sizes, dimensions, and geometries, these are all modifications that a highchair designer should be able to accomplish based on the teachings of the present invention.

SUMMARY OF THE INVENTION

A child's highchair according to one embodiment of the present invention comprises a supporting frame, a seat supported by the frame, and a back connected to the frame. The combination of the seat and back together define an included angle and the back is movable relative to the seat between a use position, where the back is fixed in position, and a loading position, where the back is reclined. In the use position, the included angle between the back and the seat is approximately ninety degrees while in the loading position, the included angle is approximately 140 degrees. A release mechanism is integrated into the highchair and is constructed and arranged for enabling the back to be movable from the use position to the loading position.

One object of the present invention is to provide an improved child's highchair.

Related objects and advantages of the present invention will be apparent from the following description.

DESCRIPTION OF THE PREFERRED EMBODIMENTS

Figure 1:
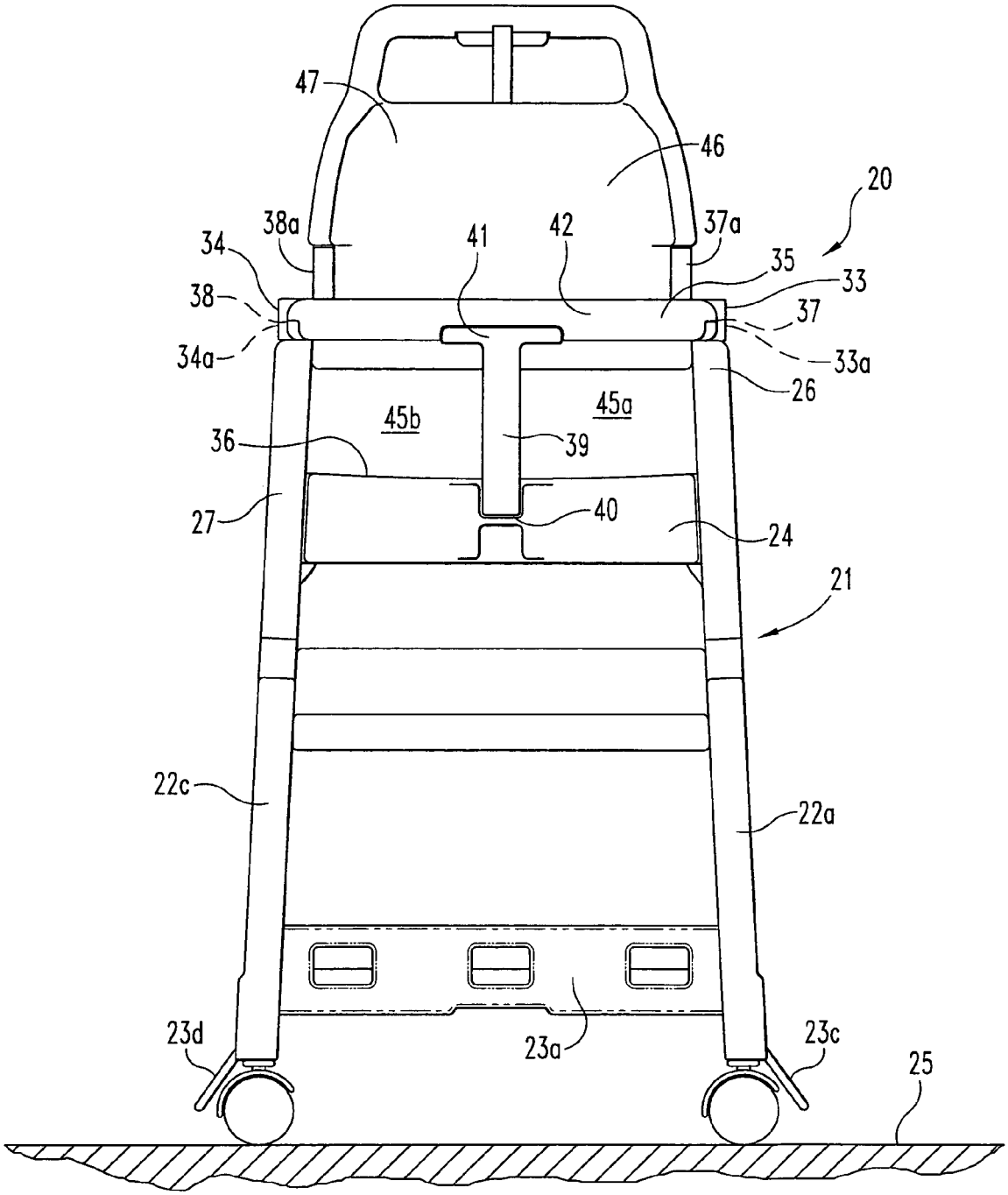
FIG. 1 is a front elevational view of a child's highchair according to a typical embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
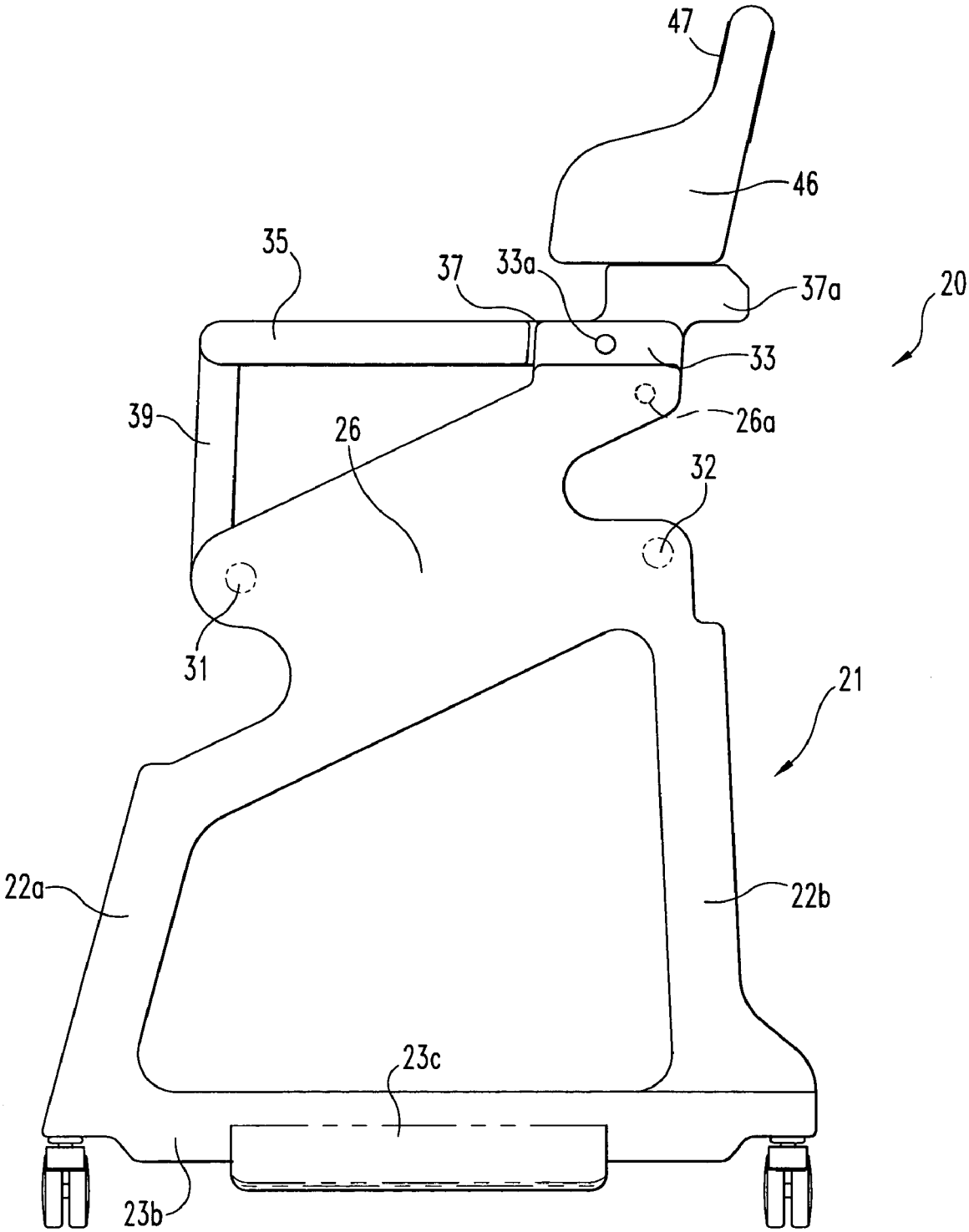
FIG. 2 is a side elevational view of the FIG. 1 highchair with a back portion oriented in a generally upright position.

Referring to FIGS. 1 and 2, there is illustrated a child's highchair 20 that is constructed and arranged according to the present invention. Highchair 20 includes a frame 21, including four legs 22*a*–22*d* that are interconnected by four stretchers. Only stretchers 23*a* and 23*b* are visible. The non-visible stretchers are symmetrically positioned. The frame 21 supports a seat 24 that is generally horizontal using the floor 25 as a horizontal plane of reference. The two legs 22*a* and 22*b* on one side extend upwardly into an integral side panel 26 that extends along one side of seat 24. The other two legs 22*c* and 22*d* on the opposite side extend upwardly into a second integral side panel 27 that extends along the opposite side of seat 24.

As will be described herein, practicing or utilization of the present invention requires an upward lifting force. Depending on the specific release mechanism that is employed for controlling the position of the back of the highchair, it may be helpful to have a surface for the foot of the user by which to apply a downward force on the highchair. For this purpose, inclined side panels 23*c* and 23*d* are included as part of frame 21 and are preferably integral with the two side stretchers. By placing one foot of the user on either of the two side panels, it is easy and convenient to hold down the highchair while manipulating the release mechanism that controls the reclining or pivoting movement of the back, as will be described.

In the specific highchair design used for highchair 20 to explain the present invention, the seat is joined to side panels 26 and 27 by the use of rods extending through the seat and captured by the sides. These rod locations are illustrated by the broken line circles at locations 31 and 32 on the illustrated left side. The opposite side is virtually the same. The orientation for what constitutes "left" or "right" is from the perspective of the child sitting in the highchair and facing forward in the normal manner.

Each side panel 26 and 27 extends upwardly to a support arm 33 and 34, respectively. The guard rail 35 that can also function to hold a tray is a three-sided form that is substantially horizontal and coplanar with the horizontal upper surface 36 of seat 24. The "free" ends 37 and 38 of guard rail 35 are securely connected to support arms 33 and 34, respectively, at bolt location 33*a* and 34*a*, respectively. Each "free" end 37 and 38 is integral with a corresponding extension 37*a* and 38*a*, respectively. The support post 39 connects at its lower end 40 to the seat 24 and at its upper end 41 to the center of front section 42 of guard rail 35.

Without the present invention being incorporated into the disclosed highchair structure, the back 46 would be securely and rigidly connected to and between the two side panels 26 and 27 at locations 26*a* and 27*a*, respectively. There may be other highchair designs where the back is connected in some fashion to the seat, but the majority of highchair designs do not connect together the back and the seat. Some designs form the back and the seat as a single unit. It is also important to note that the highchair structure disclosed so far is intended to be representative of child highchairs generally and, while the present invention is adaptable to virtually any style of highchair, the present invention is illustrated and described in the context of highchair 20.

Figure 3:
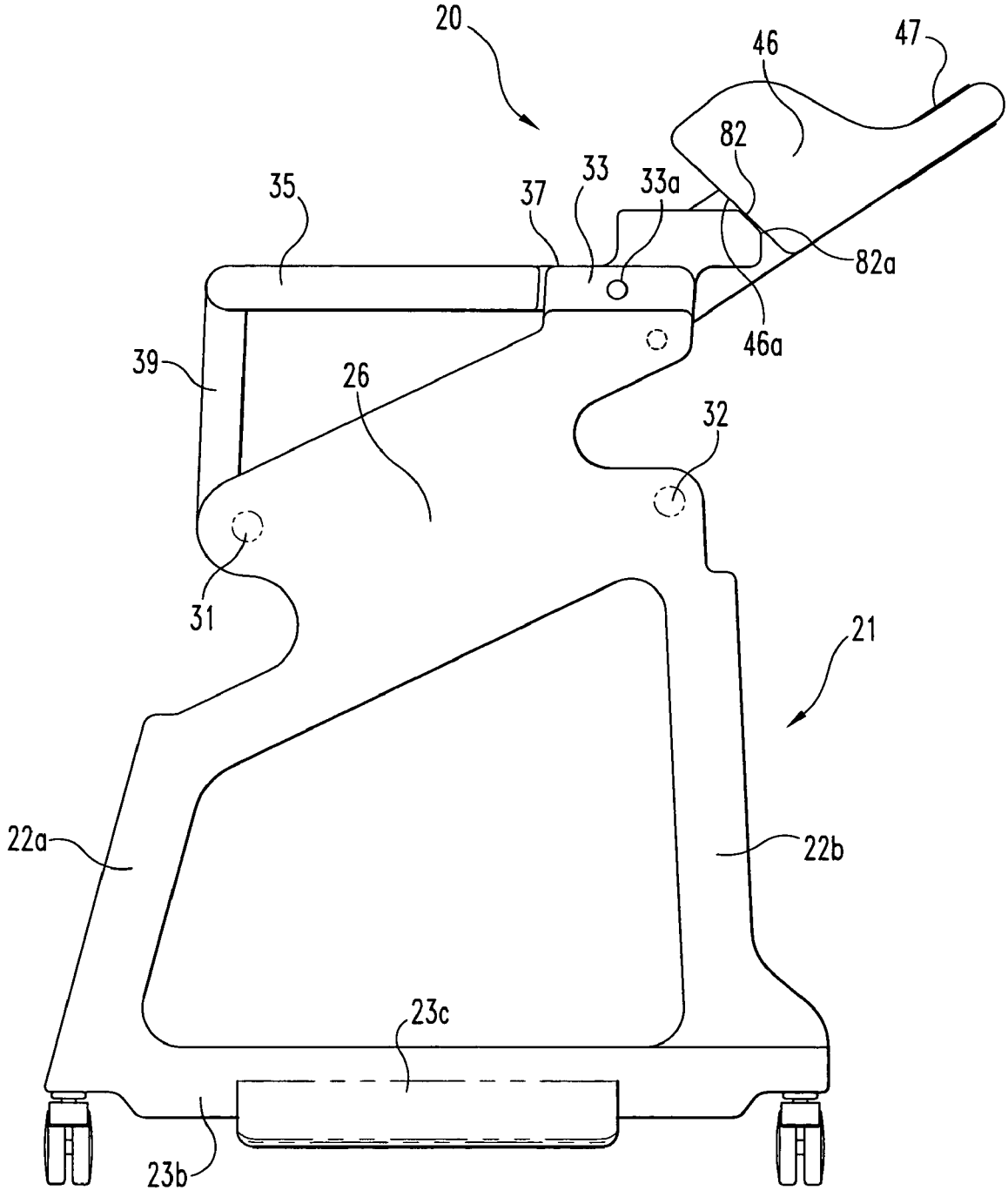
FIG. 3 is a side elevational view of the FIG. 1 highchair with the back portion in a reclining orientation.

Referring now to FIGS. 2 and 3, it will be seen that FIG. 2 represents the normal use orientation for highchair 20 wherein the seat 24 is generally upright, albeit possibly with a slight rearward angle or incline. The actual (back) surface 47 that supports the child is generally vertical, but with molded shapes and edges, there could be the appearance of a very slight rearward incline, at least to a portion of that back surface 47.

FIG. 3 represents the reclining orientation or position for back 46 of highchair 20. This tilted or reclining position would be the position for placing the child into the highchair and for inserting the legs of the child through the leg holes 45*a* and 45*b* that are defined by seat 24, guard rail 35, and support post 39. The reclining orientation can also be used by the child for a nap and when so used, the highchair doubles as an infant seat. What has actually occurred from the FIG. 2 orientation to the FIG. 3 orientation is to utilize the release mechanism 48 (see FIG. 4) of the present invention to release the spring-loaded securing pins 49 and 50 that fix the position (and orientation) of back 46 relative to the remainder of frame 21 and seat 24. Preferably, each securing pin 49 and 50 is located in an outer sleeve 57*a* and 57*b*, respectively, that is stationary with back 46 and captures a corresponding and cooperating biasing spring 57*c* and 57*d*, respectively. As will be described, when the release mechanism is manually manipulated (i.e., released), the securing pins are released from their engaged condition or inserted condition, as will be described, and the back 46 is able to tilt or recline in a backward or rearward direction so as to create a greater included angle between the upper surface 36 of seat 24 and the forward facing surface 47 of back 46. In this rearwardly tilted position, or what is described as the reclining position for back 46, it will be seen that with the greater included angle, there is a larger opening for placing the child into the highchair so as to make this task much easier. It is also important to understand that the release mechanism can be operated with only one hand.

Each securing pin 49 and 50 is a shouldered design with a larger diameter intermediate collar 49*a* and 50*a*, respectively, and a smaller diameter main body including cylindrical outer end 51 and 52, respectively, that is concentric to its corresponding collar. As will be described hereinafter, securing pins 49 and 50 cooperate with corresponding guide tracks 53 and 54. These guide tracks are configured with an opening or channel that is sized to receive the outer end 51 or 52 of the corresponding securing pin 49 or 50, respectively. By sizing the guide track to be smaller in width than the outside diameter of the securing pin collar 49*a* or 50*a*, the collar rides across the outer defining surfaces of the corresponding guide track.

By selectively counterboring larger diameter openings 53*a* and 54*a* at specific sites along the length of each guide track at laterally-aligned locations, it is intended for the collar 49*a* and 50*a* of the corresponding securing pins to snap into the counterbore as a way to secure the back 46 at that specific included angle based on where the counterbore location is placed. With a circular bore, there is no relative travel of the back relative to side panels 26 and 27 or to the rest of the highchair frame once the pins are stowed within the corresponding counterbore locations.

Figure 5:
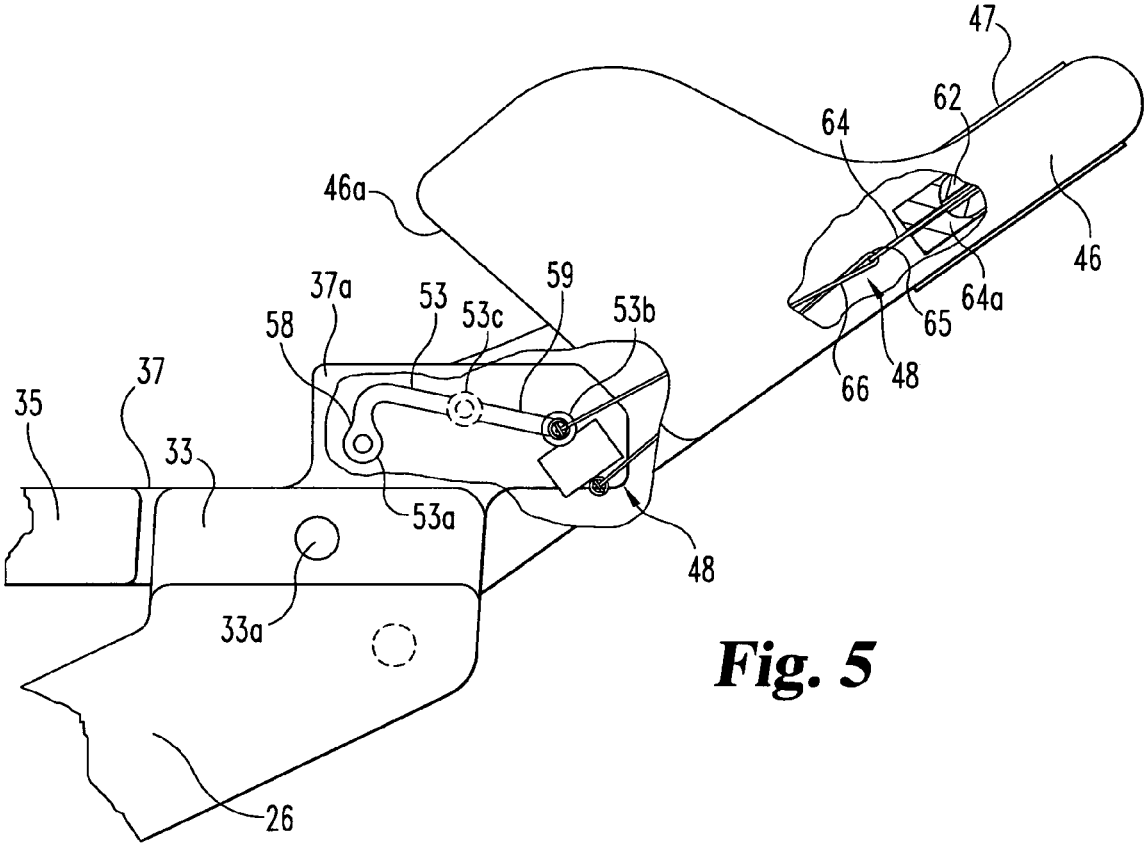
FIG. 5 is a partial, side elevational view, in partial section, illustrating the FIG. 4 release mechanism.

At a minimum, one counterbore location 53*a* is at the base of guide track 53, see FIG. 5. The opposite side guide track 54 has a similar, and laterally aligned, counterbore location 54*a*. When pins 49 and 50 snap into these counterbores, the back 46 is fixed in a generally vertical orientation. As will be understood, in order to recline the back 46, the collar 49*a* and 50*a* of each securing pin must be pulled out (moving inwardly toward each other) of the corresponding base counterbores 53*a* and 54*a* in tracks 53 and 54, respectively. With back 46 reclined and the pivot point shifted rearwardly, the child can be more easily placed in the highchair.

Once the child is in position, the back is returned to its normal upright orientation. Since each securing pin 49 and 50 cooperates with a biasing spring, releasing the release mechanism 48 allows each securing pin to automatically snap back into its engaged condition in their respective guard rail extension 37*a* and 38*a*, with each securing pin collar 49*a* and 50*a* fitting into its corresponding counterbore. The included angle between the back 46 and seat 24 in the reclined position of FIG. 3 is between approximately 140 degrees and 150 degrees and this included angle could realistically be larger. In this reclined position for back 46, the child can be placed in the highchair without the positioning of the back 46 interfering with the child. It will also be noted that as far as the main structural portions of highchair 20, it is only the back 46 that can be moved upon actuation of the release mechanism 48.

Each guard rail extension 37*a* and 38*a* is constructed and arranged such that in order to recline the back 46, the back 46 must first be lifted upwardly or raised in a generally vertical direction relative to each guard rail extension. This allows the back 46, to be manually pulled back and tilted into a reclining orientation. This construction and the travel of pins 49 and 50 in guide tracks 53 and 54, respectively, also results in moving the pivot point rearwardly. This in turn also increases the distance between the pivot point and the front section 42 of guard rail 35. Moving the pivot point rearwardly also increases the spacing between the back 46 and the front section 42.

Figure 4:
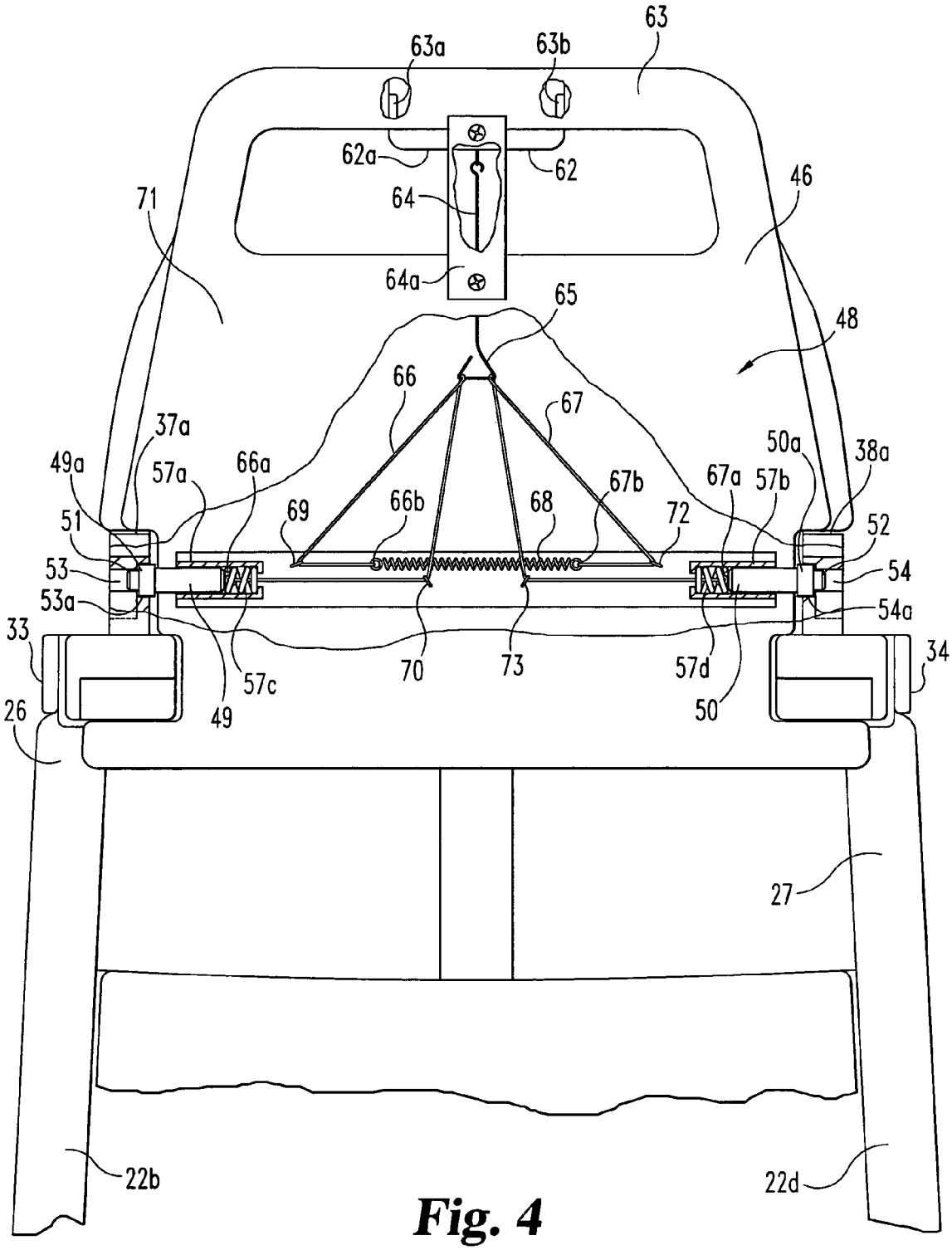
FIG. 4 is a partial, rear elevational view, in partial section, illustrating a release mechanism that comprises a portion of the FIG. 1 highchair.

With reference to FIGS. 4 and 5, the details of release mechanism 48 are illustrated. As described, the outer ends 51 and 52 of the securing pins 49 and 50, respectively, are positioned in the recessed guide tracks 53 and 54, respectively. Guide track 53 is constructed and arranged into guard rail extension 37*a* and guide track 54 is constructed and arranged into guard rail extension 38*a*. When the collar 49*a* and 50*a* of each securing pin 49 and 50 is inserted into the corresponding counterbore locations 53*a* and 54*a* of guide tracks 53 and 54, respectively, the back 46 is locked into its upright (near vertical) position that represents the normal use or ready for use position of highchair 20. When the securing pins 49 and 50 are retracted by being pulled inwardly toward each other, the back 46 is able to be moved in a rearward direction, ultimately into the described reclining orientation. Based upon the shape of each guide track 53 and 54, it is necessary to first lift the back 46 straight up before trying to recline the back 46 in a rearward direction. This straight up lifting or movement of back 46 is controlled by the travel of each securing pin 49 and 50 in its corresponding guide track 53 and 54, respectively. As will be seen in FIG. 4, guide track 53 includes a generally vertical section 58 accounting for the lifting or upward movement of the back and an angled section 59 accounting for the rearward movement and tilting or reclining of back 46. Guide track 54 has a virtually identical construction to guide track 53. Guide track 53 and 54 define the path for the movement of pins 49 and 50. The movement of pins 49 and 50 in turn controls the movement of back 46. The movement of back 46 in the rearward direction also moves the pivot point or axis about which the back reclines in a rearward direction.

Once it is understood that the insertion of each collar 49*a* and 50*a* into its corresponding counterbore location 53*a* and 54*a*, respectively, establishes a securely fixed position for back 46, it will be clear that the creation of additional counterbore locations will create other securely fixed positions for back 46. One design option considered for the present invention is to provide a second counterbore 53*b*, for example, located at the rearward end of guide track 53. If the highchair is to be used as an infant seat for a napping child, then the reclined position of back 46 is preferred, and securely fixing the back 46 in that position is preferred. Intermediate position counterbores, such as counterbore 53*c*, are also contemplated as part of the present invention for fixing the back 46 at a smaller included angle relative to the seat than what would be provided in the full or completely reclining position. Whatever counterboring is provided in guide track 53, the preferred design is to include a corresponding and laterally aligned counterbore location or pattern in guide track 54. This helps with the overall security of the back when in a stowed position and provides a better overall support such that the back is not likely to twist.

With continued reference to FIGS. 4 and 5, release mechanism 48 includes a release handle 62 that is integrated into the upper portion 63 of back 46. There is a cooperating clearance space on the interior of upper portion 63 for the handle 62 to move into when manually pulled in an upward direction. When grasping upper portion 63 with one hand, the user is able to also pull upwardly on handle 62. This means that, with only one hand, the release mechanism 48 can be manipulated. This leaves the other hand or arm free to hold or lift the child. A first linkage member 64 is securely connected to release handle 62 at one end and includes a hook 65 at the opposite end. Looped through hook 65 are flexible cables 66 and 67 that can be lengths of cord or string.

Since a variety of structural configurations can be used for the connection of release handle 62 into upper portion 63, the FIG. 4 illustration should be considered as more of a diagrammatic representation of one design option. The lower edge 62*a* of release handle 62 abuts against a relief groove in member 64*a*. This controls the movement of release handle 62 in a downward direction. In the upward direction, the clearance space in upper portion 63 accepts release handle 62. Guides 63*a* and 63*b* provide alignment for release handle 62 in order to keep release handle 62 from tilting or cocking in a side-to-side direction as it is drawn upwardly into the clearance space. This in turn ensures a more uniform or equal action of the release mechanism on both of the securing pins 49 and 50, so that they release from their counterbore location more or less simultaneously.

One end 66*a* of cable 66 is securely tied or connected to securing pin 49 and the opposite end 66*b* is tied or connected to one end of spring 68. In a similar manner, one end 67*a* of cable 67 is securely tied or connected to securing pin 50 and the opposite end 67*b* is tied or connected to the opposite end of spring 68. A pair of eyelets 69 and 70 are secured to the rear surface 71 of back 46 and these eyelets guide the path of cable 66. A second pair of eyelets 72 and 73 are secured in a similar manner as eyelets 69 and 70 to the rear surface 71 and these two eyelets guide the path of cable 67.

Pulling up on release handle 62 pulls on cables 66 and 67. While initially the spring 68 may stretch a small distance, the force required to extend the spring any greater distance quickly exceeds the force required to pull the securing pins 49 and 50 in an inward direction. Pulling the securing pins in an inward direction or retracting these pins 49 and 50 from their stowed (securing) condition causes the respective biasing springs 57*c* and 57*d* associated with pins 49 and 50 to compress within the surrounding sleeve 57*a* and 57*b*. These biasing springs return the securing pins into their stowed or engaged condition in the corresponding guide tracks when the back is returned to its upright position. Once the securing pins 49 and 50 are released so that back 46 can be manually lifted and reclined, the release handle 62 can be released. The spring-loaded securing pins 49 and 50 follow the shape of their respective guide tracks 53 and 54. Once the back 46 is lifted, handle 62 can be released and let each spring-loaded securing pin simply ride in its corresponding track. With the back 46 fully reclined, the included angle between the back and the seat is significantly greater than with the back in an upright, normal-use orientation. With this increased included angle, it is easier to place the child in the highchair. There is less bending and twisting of the child in order to slide the legs of the child into the two leg openings.

Once the child is in the highchair 20, the back is pushed forward and tilted to an upright position. This particular motion is controlled by the travel of each securing pin 49 and 50 in the angled section 59 of each corresponding guide track. Once the upper end of the corresponding vertical section 58 is reached by the corresponding securing pins, the back 46 is able to drop down a few inches so that each securing pin 49 and 50 snaps back into its corresponding counterbore 53*a* and 54*a*, respectively, that defines the lowest most point of the corresponding vertical section 58 of each guide track. When it is time to lift the child out of the highchair, the reclining of the back is performed a second time, in the same manner as described above.

Figure 6:
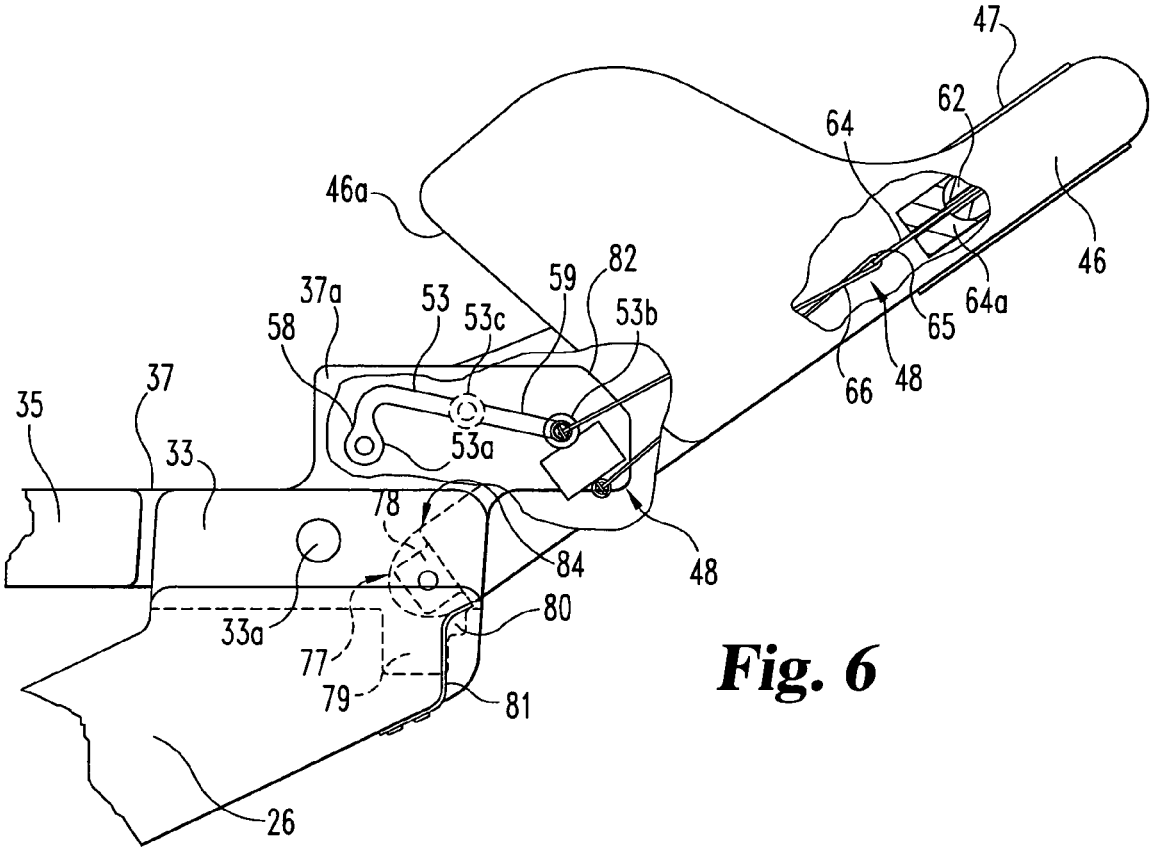
FIG. 6 is a partial, side elevational view, in partial section, illustrating other features of the FIG. 1 highchair.

With reference to FIG. 6, additional structural features are illustrated that comprise part of the present invention in terms of the specific highchair selected to explain the present invention. Notwithstanding the specific structure illustrated, the broad concept of the present invention is to provide a child's highchair with a back that can be pivoted or tilted into a reclining position in order to make it easier to place the child in the highchair. Depending on the specific highchair that is selected for incorporation of this present invention, it may be necessary to make minor structural modifications to that highchair design in order to provide all of the features of the present invention.

In the FIG. 6 illustration, the lower portion 77 of seat 46 includes a boss 78 (one on each side) that is designed to fit into a corresponding socket 79 when the back 46 is secured in its upright, normal use orientation. In order to be able to tilt or pivot the back 46 into a reclining position, each boss 78 must be lifted up out of its corresponding socket 79. This accounts for the design of vertical section 58 in each guide track. Support arms 33 and 34 are each notched out with additional clearance or relief at location 80 that is positioned above and rearwardly of socket 79. A leaf spring 81 is attached to the highchair frame in order to help guide the boss 78 back into the corresponding socket 79.

The construction of highchair 20 includes the option for three blocking or locking stops for the reclining back 46 once the back nears or reaches its designed maximum included angle relative to the seat. The one locking stop is provided by counterbore location 53*b*. One blocking location is provided by the angled taper along edge 82 of guard rail extension 37*a* relative to lower edge 46*a*. A corresponding and aligned edge is included as part of guard rail extension 38*a*. The rearward corner 82*a* of this edge 82 is contacted by edge 46*a* in order to prevent any further rearward tilting or reclining of back 46. The other blocking location 84 is created by notching or relief that is included as part of the free ends 37 and 38 of guard rail 35 relative to the design, shape, and location of the lower portion 77 of seat 46 in the vicinity of boss 78.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A child's highchair comprising:

a supporting frame defining a socket;

a seat supported by said frame;

a back assembled to said frame, said back defining a boss that is received by said socket with said back in a use position, said back being movable relative to said seat between said use position and a reclining position, wherein said movement of said back requires lifting of said back to lift said boss out of said socket; and releasable securing means for securing said back in said use position, said releasable securing means being changeable in configuration to enable said back to be moved to said reclining position, wherein said releasable securing means includes at least one securing pin that is movable between an engaged position and a retracted position, wherein said releasable securing means further includes a release handle that is movable and connected to said at least one securing pin.

2. The child's highchair of claim 1 wherein said releasable securing means further includes a second securing pin.

3. The child's highchair of claim 2 wherein the positioning of said back relative to said seat defines an included angle, said included angle increasing in degrees with movement of said back from said use position to said reclining position.

4. The child's highchair of claim 3 wherein said frame includes a pair of oppositely disposed guard rail extensions, each guard rail extension of said pair of oppositely disposed guard rail extensions receiving a corresponding one of said securing pins.

5. The child's highchair of claim 4 wherein each guard rail extension defines a corresponding guide track that receives a portion of a corresponding one of said securing pins for guiding the movement of said back.

6. A child's highchair comprising:

a supporting frame;

a seat supported by said frame;

a back assembled to said frame, said back being constructed and arranged to recline relative to said seat about a pivot point, said back being movable from a use position wherein said pivot point is in a first location to a loading position wherein said pivot point is moved to a second location, wherein said back defines an included angle with said seat, said included angle having a first measurement when said back in said use position and a second measurement when said back is in said loading position, wherein said second measurement being larger than said first measurement, wherein said first measurement is between approximately 90 degrees and 100 degrees, and wherein said second measurement is between approximately 140 degrees and 150 degrees; and a release mechanism integrated into said highchair and being constructed and arranged for enabling said back to be movable from said use position to said loading position.

7. The child's highchair of claim 6 wherein said frame includes a pair of oppositely disposed guard rail extensions, each guard rail extension of said pair of oppositely disposed guard rail extensions receiving a securing pin.

8. A child's highchair comprising:

a supporting frame;

a seat supported by said frame;

a back assembled to said frame, said back being constructed and arranged to recline relative to said seat about a pivot point said back being movable from a use position wherein said pivot point is in a first location to a loading position wherein said pivot point is moved to a second location; and a release mechanism integrated into said highchair and being constructed and arranged for enabling said back to be movable from said use position to said loading position, wherein said release mechanism includes at least one securing pin that is movable between an engaged position and a retracted position, wherein said release mechanism further includes a release handle that is movable and connected to said at least one securing pin.

9. The child's highchair of claim 8 wherein said release mechanism further includes a second securing pin.

* * * * *